US005252004A

United States Patent [19]

Butler et al.

[11] Patent Number: 5,252,004

[45] Date of Patent: Oct. 12, 1993

[54] ROD ACCUMULATOR RISER TENSIONING CYLINDER ASSEMBLY

[75] Inventors: Bryan V. Butler, Irvine; Jeffrey P. Taylor, Trabuco Canyon, both of Calif.

[73] Assignee: Paul-Munroe Engineering, Orange, Calif.

[21] Appl. No.: 912,734

[22] Filed: Jul. 13, 1992

[51] Int. Cl.[5] ..... E21B 43/01

[52] U.S. Cl. ..... 405/211; 405/224.4

[58] Field of Search ..... 405/195.1, 224.2, 224.4, 405/211, 216; 166/367, 350, 359, 364; 175/5-10; 267/124-129

[56] References Cited

U.S. PATENT DOCUMENTS 3,804,216 4/1974 Katsumori et al. ..... 188/314
4,883,387 11/1989 Myers et al. ..... 405/195.1 X
5,158,397 10/1992 Koos et al. ..... 405/195.1

FOREIGN PATENT DOCUMENTS 1361902 7/1974 United Kingdom .
1382249 1/1975 United Kingdom .
1382250 1/1975 United Kingdom .

*Primary Examiner*—David H. Corbin
*Attorney, Agent, or Firm*—Frank D. Gilliam

[57] ABSTRACT

A "rod accumulator" riser tensioning cylinder assembly for use with off-shore production and exploratory drilling facilities. The tensioner is basically a hydro-pneumatic spring having a tubular cylinder equipped with a hollow rod containing sufficient volume to act as an accumulator. The rod is internally ported to the annulus of the cylinder. The cylinder exterior is coated with a material that will insulate the unit when exposed to high temperature and flame. A wear sleeve is supplied over the insulation material to provide a low friction surface for an outer, cylindrically shaped rod insulation jacket to slide over the cylinder when the rod is stroked into the cylinder. When the rod is stroked out, the jacket is also extended, protecting the rod from flame and high temperature due to its insulative properties. This is a low mass and low volume system, with low lateral area so that an increased number of such cylinder assemblies can be provided in a given horizontal area.

17 Claims, 3 Drawing Sheets

ROD ACCUMULATOR RISER TENSIONING CYLINDER ASSEMBLY

BACKGROUND OF THE INVENTION

This invention relates in general to tensioning of risers used in oil production and exploratory drilling and, more specifically, to an improved riser tensioner assembly for such use.

Off shore oil drilling and production operations are conducted through a pipe, called a riser, running from the subsea wellhead to the surface platform or floating vessel In order to support the weight of these risers and to control the stresses induced by ocean currents and vessel motions, the upper end of the riser is connected to a tensioning device. This riser tensioner maintains a predetermined range of tension throughout the range of vertical and lateral motions of the drilling or production rig.

The conventional approach to tensioning risers is to use a combination of a hydraulic or pneumatic mechanical cylinder, pressurized using a compressed gas, to apply the tensioning forces to the riser. Each riser tensioner is located on a deck of the floating platform or floating vessel and structurally connected through its cylinders to the riser. The cylinders may be connected to the risers with wire rope or chain or directly connected through cylinder rods. The pressurized gas volume is typically contained in a separate pressure vessel referred to as an "accumulator", positioned alongside the cylinder, which supplies sufficient gas volume to act as a gas spring. This combination of cylinder and accumulator acts to compress or expand the gas in response to vessel or riser movements, maintaining a relatively uniform tension level in the riser.

This traditional approach to riser tensioning using separate cylinders and accumulators acting together has worked satisfactorily in most cases, but is not space efficient. The deck area at the platform or vessel required for each riser and its tensioner is significant and maximum utilization of the space on the vessel or platform is economically significant and can limit the number of wells that can be accommodated without enlarging the platform.

In addition, safety considerations related to personnel, investment, and ecological considerations have driven regulatory agencies to require protection of critical equipment from destruction by fire. Risers and tensioners have typically been designated as critical components that must continue to remain safe during an accidental fire.

Protection of a riser tensioner from fire in the past was generally accomplished by a water deluge system; under new requirements the tensioner is protected using heat and flame insulation materials. For a given fire hazard scenario, the selection of these materials is a function of the exposed surface area. In the typical riser tensioner arrangement with separate cylinder and accumulator there is a high exposed surface area requiring a substantial amount of insulation. This adds significant cost and weight to each tensioner unit.

The insulation is used to delay the transmission of heat to the metal parts of the tensioner, keeping them from heating up and softening. The rate of increase in metal temperature is also determined by its size (i.e., mass). The smaller the mass of a tensioner, the faster the temperature will rise as a given amount of heat passes through the protective insulation. Thus, the lower the ratio of insulation area divided by the protected mass, the longer it will take for the metal temperature to rise, and the better the system will perform during a fire. For a typical fire protected cylinder, the highest ratio of jacket area to protected metal is the extended rod of the cylinder; thus, it is the most critical component and is most likely to heat up to a softening point and eventually fail.

A number of different riser tensioner systems have been developed. Typical of such systems are those disclosed by Widiner et al in U.S. Pat. No. 4,379,657 and by Stevenson in U.S. Pat. No. 4,215,950. Widner et al disclose a tensioner having a tensioner with separate accumulator and cylinder, having the weight and volume problems discussed above. Stevenson mounts a tensioner on a gimbal arrangement that may have some alignment advantages but which increases the weight and volume problems.

Jaqua, in U.S. Pat. No. 4,799,827 discloses a riser tensioner in which the accumulator surrounds the cylinder. While this arrangement reduces the volume of the tensioner, a solid piston rod is used that will accumulate heat in a fire situation, as discussed above, and fully effective heat insulation is not provided.

A complex hydropneumatic cable tensioner is described by Jordan in U.S. Pat. Nos. 4,638,978 and 4,540,159. High pressure gas is provided to an oil filled accumulator which in turn acts on the cylinder piston This design seems to be primarily concerned with avoiding tensioner damage in the event of sudden release of cable forces on the tensioner. With complexity comes an increased likelihood of failures. An effective heat insulation system for fire protection is not provided.

Thus, there is a continuing need for improved riser tensioners for use with off shore oil drilling and production facilities, which have lower volume and mass, improved simplicity and reliability, lower lateral areas and improved resistance to damage from fire.

SUMMARY OF THE INVENTION

It is, therefore, an object of this invention to provide a riser tensioner assembly of improved mass/external area ratio and volume. Another object is to provide a tensioner occupying less lateral area to permit a greater number to occupy a given area. A further object is to provide a tensioner having improved simplicity and reliability. Yet another object is to provide a thermal insulation system for a tensioner with improved resistance to fire damage.

The above-noted objects, and others, are accomplished in accordance with this invention by a riser tensioner assembly basically comprising a tubular cylinder having one closed end and a hollow piston rod slidably movable in the cylinder, through the open cylinder end. The hollow rod contains the hydraulic liquid and pressurizing gas, serving the function of the normally separate accumulator. The outer surface of the rod is spaced from the inner wall of the cylinder, providing an annular space therebetween. Slidable seal means seal the ends of said annular space. Openings through the wall of the hollow rod near the closed end of the cylinder allow the hydraulic fluid to pass from the interior of the rod to the annular space, biasing the rod toward the fully inserted position.

In order to protect the assembly against damage due to fire, which might cause the tensioner to fail and permit the riser to break away from the off shore production or drilling facility on a vessel or platform, heat insulation means is provided around the cylinder. The insulation cover acts as a weather shield for the rod, and includes an outermost insulating sleeve assembly slidably surrounding the cylinder and moving with the hollow rod to protect the rod from incident fire and heat and a layer of material on the cylinder that provides thermal insulation.

BRIEF DESCRIPTION OF THE DRAWING

Details of the invention, and of certain preferred embodiments thereof, will be further understood upon reference to the drawing, wherein.

DETAILED DESCRIPTION OF PREFERRED EMBODIMENTS

Figure 1:
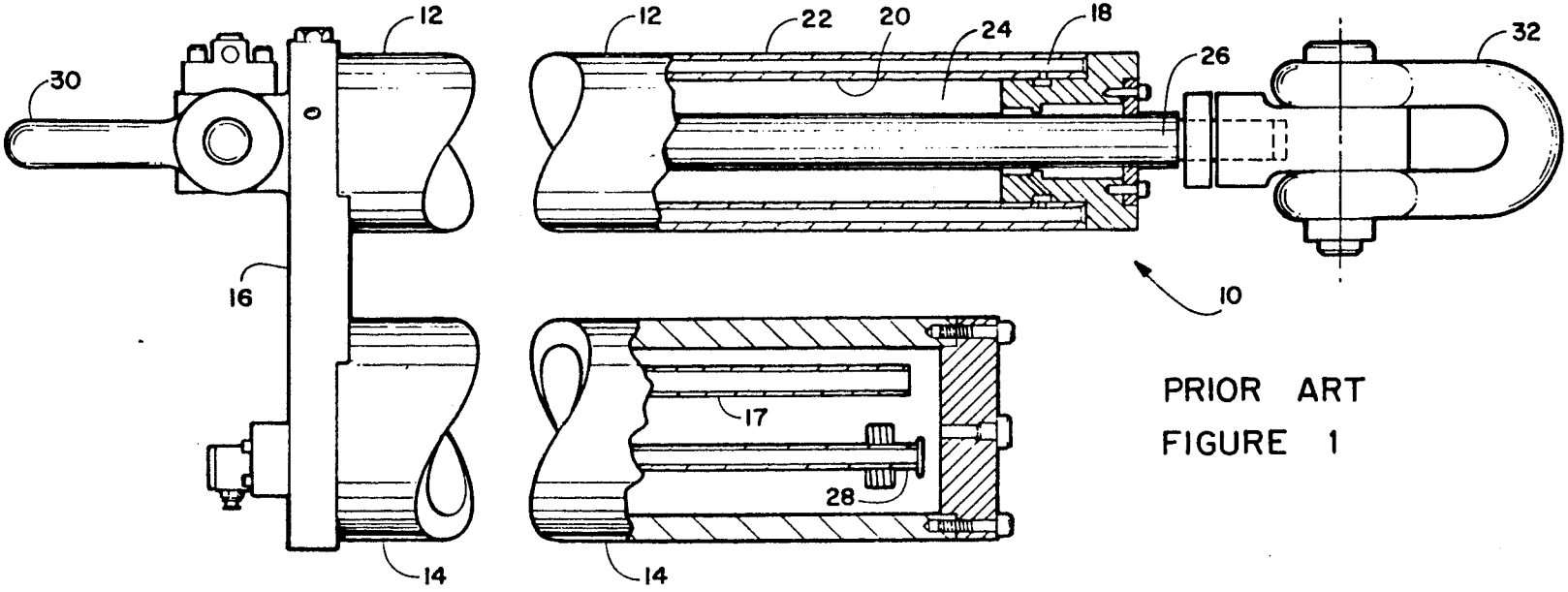
PRIOR ART FIGURE 1
FIG. 1 is an elevation view of a riser tensioner assembly according to the prior art, partially cut away.

Referring now to FIG. 1 there is seen an elevation view of a conventional riser tensioner of the sort that is in widespread use, partially cut-away to reveal internal components. Basically, conventional tensioner 10 includes a hydraulic cylinder 12 and a pressurized gas filled accumulator 14, connected by a bracket 16 through which an aperture 18 (partially shown) extends to permit hydraulic fluid under pressure of gas in accumulator 14 (through tube 17) to enter the space 18 between inner wall 20 and outer wall 22 of cylinder 10. The hydraulic fluid enters the interior space 24 within cylinder 10 and bears against a piston (not shown) at the end of piston rod 26, biasing the piston and rod 24 towards the fully inserted position. A liquid level sensor 28 is provided within accumulator 14. An upper clevis 30 on cylinder 12 is provided for attachment, directly or indirectly, to the platform or vessel. A lower clevis 32 on rod 26 is provided for connection to the riser.

As is apparent, the traditional design as shown in FIG. 1 is rather wide. Where a number of risers, each having at least one tensioner, are spaced out on the deck of an oil production platform or vessel, the deck area taken up by this tensioner is such as to limit the number of risers that can be handled in a given platform area. Also, the fluid flow apertures required for this prior art tensioner are more complex, with numerous connections and a large number of parts and is difficult to surround by thermal insulation to protect the tensioner in the event of a fire. Fully enclosing this tensioner with insulation will greatly increase the lateral space occupied by each tensioner, further limiting the number of risers that can be accommodated at a given platform or vessel.

The riser tensioning assembly of this invention is shown in FIGS. 2–7. As can be seen, this novel tensioner is simple, narrow, and easily covered by insulation for fire protection.

Figure 2:
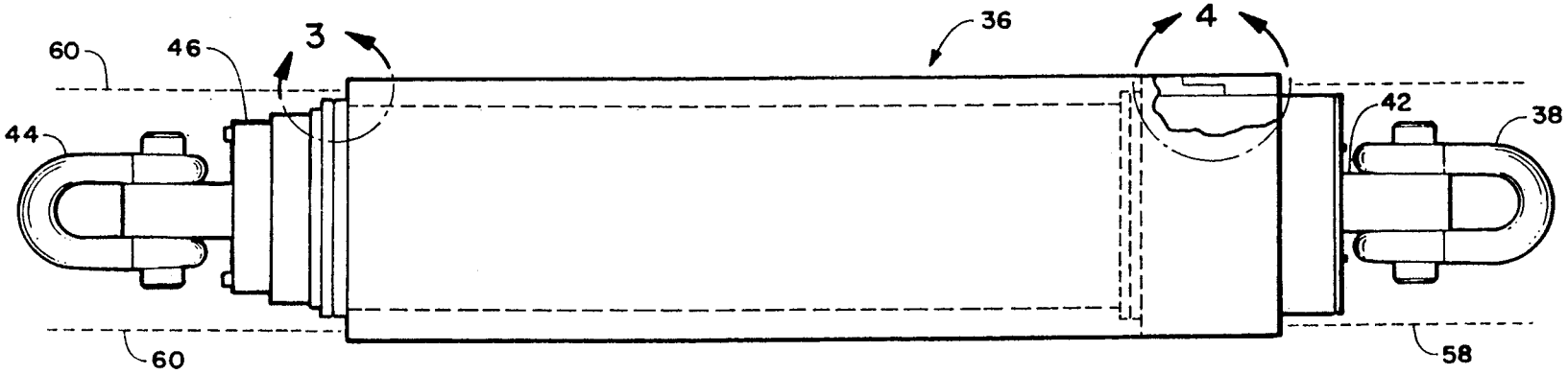
FIG. 2 is an elevation view of the riser tensioner assembly of this invention.
Figure 3:
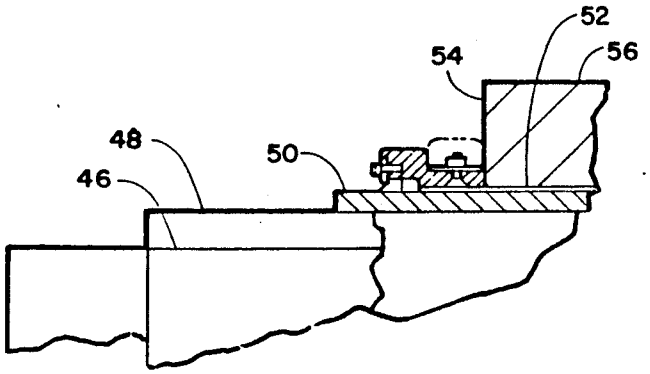
FIG. 3 is a detail section view of the fire jacket seal, taken at 3—3 in FIG. 2.
Figure 4:
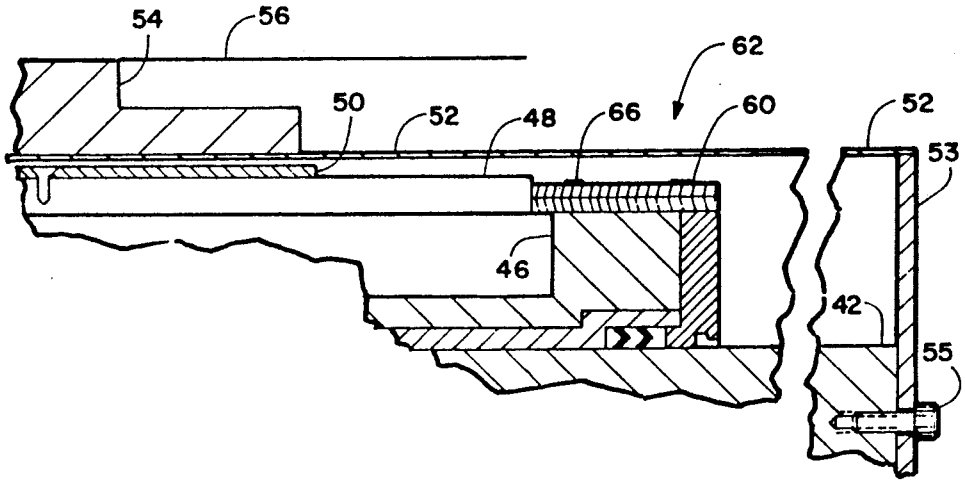
FIG. 4 is a detail section view of the fire stops at the cylinder open end, taken at 4—4 in FIG. 2.

FIG. 2 shows a schematic elevation view of tensioner 36 incorporating the novel insulation system of this invention, as detailed in FIGS. 3 and 4. In the embodiment shown, an upper clevis is fastened to a sliding hollow piston rod 42 that serves as the pressurized gas and hydraulic fluid accumulator, corresponding in function to separate accumulator 14 and rod 26 of FIG. 1. A lower clevis 44 is fastened to cylinder 46, which corresponds in function to cylinder 12 in FIG. 1.

FIGS. 3 and 4 show details of the thermal insulation system for fire protection. A layer 48 of insulating material, in one embodiment a layer of intumescent material that foams in response to heat, is formed over the outer surface of cylinder 46. Layer 48 may be formed from any suitable insulation material to any suitable thickness with appropriate insulation properties under exposure to fire. Typically an intumescent layer 46 could be formed from any suitable material, such as an epoxy or polyimide material with suitable foam forming ingredient.

A low friction organic compound bearing sleeve 50 is provided over layer 48. Any suitable plastic may be used, such as the fluorocarbon resins available from E. I. duPont de Nemours & Co. under the Teflon trademark. Sleeve 50 can be manufactured from standard plastic tubing or molded in two half cylinder shapes. Sleeve 50 provides a smooth, low friction surface for the outer fire jacket to move over.

A metal tube 52 is slipped over sleeve 50. Tube 52 is easily slidable relative to sleeve 50. While any suitable metal may be used for tube 52, stainless steel is preferred for strength with light weight and resistance to corrosion. Tube 52 is secured to cylinder 42 by a fire protection support plate 53 fastened to cylinder 42 by bolts 55.

A fire jacket 54 of insulating material, that is rated for 2000° F. service, available from Paul-Munroe Engineering under the PC2000 designation, is then wrapped around tube 52. The tube 52 and fire jacket 54 are attached to the end of rod 42 by any suitable mechanical means. The insulation thus encircles and protects the rod from fire even when the rod is stroked out of the cylinder. The tube 52 and jacket 54 may be extended over clevis 44 and clevis 38 to the extent required to provide connection to adjacent fire jackets, as indicated by broken lines 58 and 60 in FIG. 2. Fire jacket 54 thus remains fixed to the rod while cylinder 46 moves with the riser, as explained in greater detail below.

At the open end of cylinder 46, adjacent to seal 62 described below, an encircling fire stop 64 is formed and attached around cylinder 46 by banding straps 66.

In the event of a fire, the volume within fire jacket 54 and tube 52 covering the portion of rod 42 that extends from the barrel of cylinder 46 is sealed off by the layer of fire stop material 64 which rapidly expands to seal against the inner surface of tube 52, preventing a heat and flame path from forming. Sleeve 50 is consumed by the fire, exposing the insulation layer 48 which may be a intumescent material which intumesces, forming a highly effective insulative layer. The hollow rod is provided with a high temperature pressure release aperture so that gas pressure is lost as the rod strokes out of the cylinder to the fire survival position. The protected mass of rod 42 is typically about four times greater than the mass of a conventional rod, such as rod 26 in FIG. 1, so that the temperature rise is much slower in the rod mass, enhancing survivability of the installation. This heat capacity is additionally expanded by the internal volume of hydraulic fluid within the rod accumulator.

Preferably, the hydraulic fluid is a water based fluid having considerable heat capacity.

Figure 5:
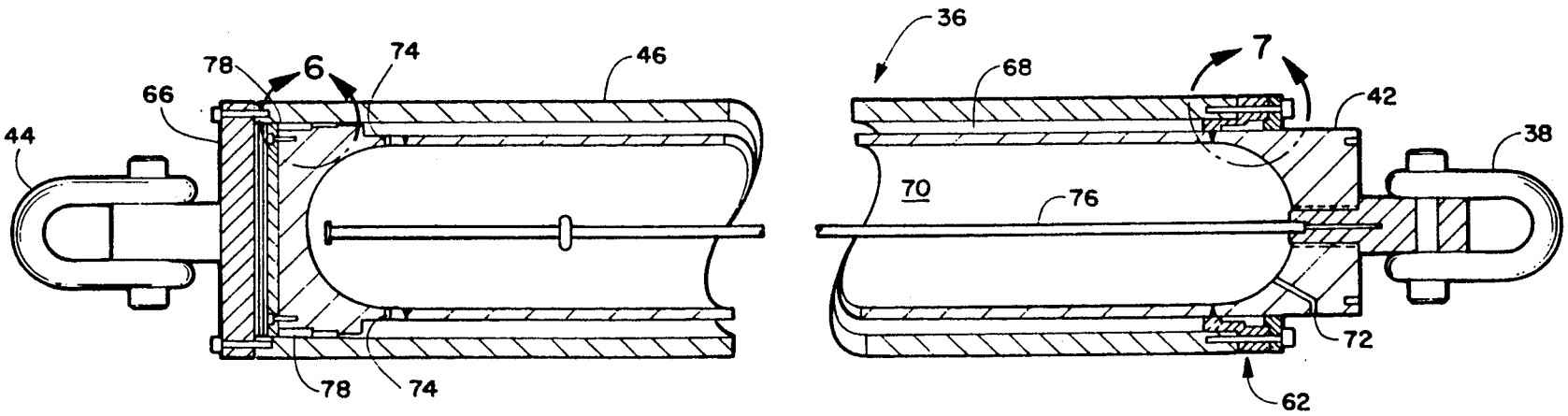
FIG. 5 is an axial section view of the riser tensioner assembly of FIG. 2.
Figure 7:
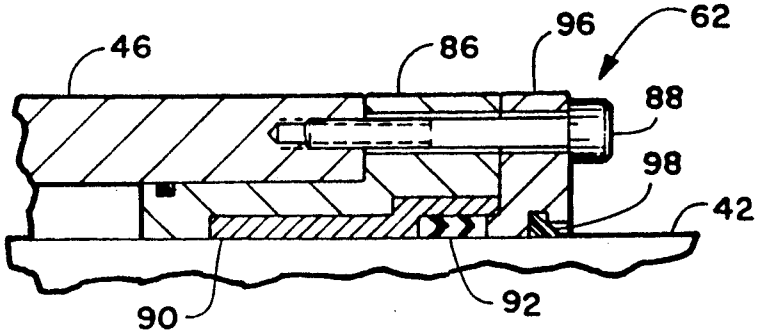
FIG. 7 is a detail section view of the cylinder wall seal, taken at 7—7 in FIG. 3.
Figure 6:
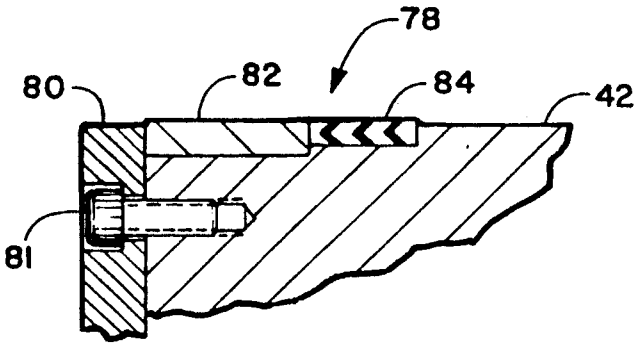
FIG. 6 is a detail section view of the piston rod seal, taken at 6—6 in FIG. 3.

FIGS. 5–7 provide details of the internal structure of the riser tensioner of this invention. The thermal insulation materials are omitted from these Figures for clarity. Basically, tensioner 36 comprises tubular cylinder 46, closed at one end by cap 66 to which clevis 44 is fastened. Rod 42, which serves as the hydraulic cylinder piston and accumulator, slides within cylinder 46 and mounts clevis 38 at its free end The outside diameter of rod 42 is less than the inside diameter of cylinder 46, forming an annular space 68 therebetween. Rod internal volume 70 is partially filled with hydraulic fluid (in use, tensioner 36 is approximately vertical, with clevis 38 being uppermost) with the remaining volume occupied by pressurized gas. An inlet 72 is provided for admitting pressurizing gas to adjust the pressure. Fluid communication to annular space 68 is provided through a plurality of holes 74 to bias rod 42 toward the fully closed (stroked in) position shown. Forces pulling clevis 38 away from clevis 44 can withdraw rod 42 from cylinder 46 against this spring-like bias. When these forces are reduced, the internal pressure will return the rod to the closed position.

Clevis 38 is preferably threaded into the free end of rod 42 so that it can be removed to permit inspection and fluid level adjustments in the rod volume and to permit an optional liquid level sensor 76 to be inserted.

In order to retain hydraulic fluid in annular space 68, a seal assembly 62 is provided adjacent to the open end of cylinder 46 to sealingly engage rod 42 and a seal assembly 78 is provided on the inner end of rod 42 to sealingly engage the inner surface of cylinder 46. Details of these seal assemblies 62 and 78 are provided in FIGS. 6 and 7, respectively.

As seen in FIG. 6, in seal assembly 78, a resilient end cap 80 is fastened to the end of rod 42 by bolts 81 to hold a bearing ring 82 in place and hold a conventional V-pack sealing ring in place. This seal prevents pressure loss as rod 42 moves relative to cylinder 46.

As seen in FIG. 7, seal assembly 62 includes a ring-like cylinder end cap 86 held to the open end of cylinder 46 by a plurality of bolts 88. A rod bearing 90 fits against end cap 86 and supports a V-pack seal 92, which is held in place by packing gland 94. A rod wiper-scraper 98 is formed in an edge of packing gland 96.

While certain preferred materials, arrangements and dimensions are specified or shown in the above description of preferred embodiments, those can be varied, where suitable, with similar results. For example, other seal arrangements and insulation compositions may be used, if desired. Other applications, variations and ramifications of this invention will occur to those skilled in the art upon reading this disclosure. Those are intended to be included within the scope of this invention, as defined in the appended claims.

We claim:

1. A riser tensioner cylinder assembly which comprises:

a tubular cylinder having an open first end and a closed second end;

a hollow piston rod positioned within said cylinder and adapted to slide inwardly and outwardly of said open first end;

said hollow rod adapted to contain a liquid and a gas under pressure;

the outer surface of said rod spaced from the inner surface of said cylinder to provide an annular space therebetween;

first seal means secured to the inner surface of said cylinder adjacent to said open end of said cylinder adapted to slidably seal against said outer surface of said rod;

second seal means secured to the outer surface of said rod extending into said cylinder, adapted to slidably seal against said inner surface of said cylinder; and at least one opening through the hollow rod wall communicating between said annular space and the interior of said hollow rod adjacent to said second seal means;

whereby a pressurized fluid within said hollow rod will act to resist withdrawal of said rod from said cylinder and to move said rod toward a position fully inserted into said cylinder.

2. The riser tensioner cylinder assembly according to claim 1 where a hydraulic liquid fills a selected portion of the volume of said hollow rod and said annular space and a compressed gas fills the remainder of said volume.

3. The riser tensioner cylinder assembly according to claim 2 wherein said fluid is a water based liquid.

4. The riser tensioner cylinder assembly according to claim 1 further including a gas inlet means communicating with the hollow rod volume, said inlet located at the outer end of said rod extending beyond said cylinder.

5. The riser tensioner cylinder assembly according to claim 1 further including first attachment means fastened to said outer end of said rod and second attachment means secured to said closed end of said cylinder; whereby said assembly can be secured between a riser and a support structure with said first attachment means extending in a generally upward direction.

6. The riser tensioner cylinder assembly according to claim 5 wherein said first attachment means is mechanically secured in said outer end of said cylinder and carries a liquid level sensor extending into said hollow rod.

7. The riser tensioner cylinder assembly according to claim 1 wherein fire resistant heat insulation is provided around said assembly.

8. The riser tensioner cylinder assembly according to claim 7 wherein said insulation comprises a layer of intumescent material coating at least portions of the exterior of said cylinder, said intumescent material adapted to intumesce when exposed to fire to provide increased heat insulation.

9. A riser tension cylinder assembly which comprises:

a tubular cylinder having an open first end and a closed second end;

a hollow piston rod positioned within said cylinder and adapted to slide inwardly and outwardly of said open first end;

said hollow rod adapted to contain a liquid and a gas under pressure;

the outer surface of said rod spaced from the inner surface of said cylinder to provide an annular space therebetween; and a fire resistant heat insulation jacket assembly of substantially uniform thickness attached to said rod outside of said cylinder and adapted to slide over the surface of said cylinder as said rod moves inwardly and outwardly of said cylinder.

10. The riser tensioner cylinder assembly according to claim 9 wherein said fire jacket assembly comprises:

a bearing sleeve secured to the outer wall of said cylinder;

a tube surrounding said sleeve and adapted to slide relative thereto; and a tube of heat insulating material surrounding said metal tube and secured thereto.

11. The riser tensioner cylinder assembly according to claim 10 further including slidable seal means at the end of said fire jacket assembly opposite said attachment to said rod to seal between said metal tube and said sleeve.

12. The riser tensioner cylinder assembly according to claim 10 further including a layer of intumescent material coating at least portions of the exterior of said cylinder between said cylinder exterior surface and said sleeve, said intumescent material adapted to intumesce when exposed to fire to provide increased heat insulation.

13. The riser tensioner cylinder assembly according to claim 10 further including additional insulation extending beyond the ends of said cylinder and rod.

14. Fire resistant thermal insulation for a riser tensioning cylinder assembly having a rod slidable within a cylinder which comprises a fire jacket assembly attached to said rod beyond said cylinder and adapted to slide over the surface of said cylinder as said rod moves inwardly and outwardly of said cylinder, said fire jacket assembly comprising a bearing sleeve ,secured to the outer wall of said cylinder, a tube surrounding metal said sleeve and adapted to slide relative thereto, a tube of heat insulating material surrounding said metal tube and secured thereto, an outer flexible fabric tube surrounding said tube and secured thereto and an outer insulating cover surrounding said insulating material and secured thereto.

15. The fire resistant thermal insulation according to claim 14 further including sliding seal means at the end of said fire jacket assembly opposite said attachment to said rod to seal between said metal tube and said sleeve.

16. The fire resistant thermal insulation according to claim 14 further including a layer of intumescent material coating at least portions of the exterior of said cylinder between said cylinder exterior surface and said sleeve, said intumescent material adapted to intumesce when exposed to fire to provide increased heat insulation and seal interstices.

17. The fire resistant thermal insulation according to claim 14 further including additional insulation extending beyond the ends of said cylinder and rod.

* * * * *